United States Patent [19]

Reboa et al.

[11] Patent Number: 4,842,757

[45] Date of Patent: Jun. 27, 1989

[54] THICKENED LIQUID, IMPROVED STABILITY ABRASIVE CLEANSER

[75] Inventors: Paul F. Reboa, Dublin; Frances E. Mitchell, Pleasanton; Clement K. Choy, Walnut Creek, all of Calif.

[73] Assignee: The Clorox Company, Oakland, Calif.

[21] Appl. No.: 146,519

[22] Filed: Jan. 21, 1988

[51] Int. Cl.[4] ..... C11D 7/54

[52] U.S. Cl. ..... 252/76; 252/94; 252/97; 252/99; 252/116; 252/128; 252/133; 252/135; 252/160; 252/174.25; 252/539; 252/558; 252/DIG. 14

[58] Field of Search ..... 252/96, 99, 116, 128, 252/133, 135, 539, 156, 160, 558, 174.25, DIG. 14

[56] References Cited

U.S. PATENT DOCUMENTS

| | | | |
|---|---|---|---|
| 3,558,496 | 1/1971 | Zmoda | 252/95 |
| 3,630,922 | 12/1971 | McClain et al. | 252/99 |
| 3,684,722 | 8/1972 | Hynam et al. | 252/98 |
| 3,884,826 | 5/1975 | Phares, Jr. et al. | 252/106 |
| 3,956,158 | 5/1976 | Donaldson | 252/102 |
| 3,966,432 | 6/1976 | Rayner | 51/308 |
| 4,005,027 | 1/1977 | Hartman | 252/95 |
| 4,051,056 | 9/1977 | Hartman | 252/99 |
| 4,129,527 | 12/1978 | Clark et al. | 252/547 |
| 4,145,694 | 5/1979 | Donaldson | 252/98 |
| 4,158,553 | 6/1979 | Chapman | 51/304 |
| 4,235,732 | 11/1980 | Beyer | 252/103 |
| 4,240,919 | 12/1980 | Chapman | 252/95 |
| 4,248,728 | 2/1981 | Puryear | 252/103 |
| 4,287,079 | 9/1981 | Robinson | 252/99 |
| 4,337,163 | 6/1982 | Schilp | 252/96 |
| 4,352,678 | 10/1982 | Jones et al. | 51/307 |
| 4,396,525 | 8/1983 | Rubin et al. | 252/174.25 |
| 4,397,755 | 8/1983 | Brierley et al. | 252/113 |
| 4,438,016 | 3/1984 | Kiewert et al. | 252/174.25 |
| 4,508,634 | 4/1985 | Elepano et al. | 252/163 |
| 4,599,186 | 7/1986 | Choy et al. | 252/102 |
| 4,657,692 | 4/1987 | Choy et al. | 252/99 |
| 4,695,394 | 9/1987 | Choy et al. | 252/97 |

FOREIGN PATENT DOCUMENTS

| | | |
|---|---|---|
| 75813 | 4/1983 | European Pat. Off. . |
| 216416 | 4/1987 | European Pat. Off. . |
| 2031455 | 4/1980 | United Kingdom . |

OTHER PUBLICATIONS

Condea Chemie Pural Puralox Disperal High Purity Aluminas Brochure. Pre. 1988.

Conoco Catapal SB Alumina Brochure (1981).

Remet Chemical Corp. Product Data Sheets, 1/21/81 and 5/4/81.

European Search Report, Published EP 206,534.

European Search Report, Published EP 159,923.

Chem. Abs. 102:15129 (p. 108) (1985), reporting on Cs 217,046.

*Primary Examiner*—Paul Lieberman

*Assistant Examiner*—Hoa Van Le

*Attorney, Agent, or Firm*—Joel J. Hayashida; Michael J. Mazza; Stephen M. Westbrook

[57] ABSTRACT

The invention provides a composition comprising and a method for making a thickened liquid abrasive cleanser with enhanced long-term phase stability, said cleanser comprising:

(a) a colloidal aluminum oxide thickener having an average particle size, in dispersion, of no greater than 1 micron;

(b) a fatty acid soap;

(c) a bleach stable nonionic surfactant;

(d) a buffer/electrolyte which interacts with the surfactants of (b) and (c) and the thickener of (a) to result in a plastic rheology;

(e) a halogen bleach;

(f) an abrasive having a particle size of between 1 and 400 microns;

(g) a phase stabilizing amount of a $C_{10-15}$ alkyl benzene sulfonate; and (h) the remainder, water and minor amounts of miscellaneous additives.

9 Claims, No Drawings

THICKENED LIQUID, IMPROVED STABILITY ABRASIVE CLEANSER

TECHNICAL FIELD

This invention relates to thickened aqueous scouring cleansers which contain abrasives and a bleach source and which have improved resistance to phase separation.

BACKGROUND OF THE INVENTION

In the quest for hard surface cleansers which have efficacy against a variety of soils and stains, various heavy duty liquid cleansers have been developed. As an example, U.S. Pat. No. 3,985,668 issued to Hartman, shows a combination of perlite (an expanded silica abrasive, which is here used as a filler), a colloid-forming clay, in combination with a hypochlorite bleach, a surfactant and a buffer in which abrasives are suspended. A clay thickened system of this type tends to set up or harden upon storage due to the false body nature of the thickeners. They require shaking before use to break down the false body structure. Further prior art cleansers which attempt to suspend abrasives use either inorganic colloid thickeners only or mixed surfactant thickeners at high levels of surfactants. Additionally, syneresis becomes a problem as the solids portion of such cleansers substantially separate from the liquids portion. One way to alleviate this is to use a perlite type material with specified particle size as defined in U.S. Pat. No. 3,985,668, issued to Hartman. Additionally, high levels of surfactants can be used to form a plastic rheology for suspension of abrasives. However, they also have a detrimental effect on hypochlorite stability. These mixed surfactant thickened compositions, for example, U.S. Pat. No. 4,352,678, issued to Jones et al, have been used to suspend abrasives and incorporate a source of hypochlorite bleach. However, this particular cleanser must incorporate large amounts of surfactants in order to suspend abrasives. This has the unfortunate disadvantage of resultant poor hypochlorite stability in terms of half-life stability at 50° C. for low levels of hypochlorite (0.5% sodium hypochlorite initial level). For the instant purpose, half-life stability is defined as the amount of time it takes for 50% of the initial amount of bleach present in a given composition to decompose.

Other efforts in the cleanser field have included: U.S. Pat. No. 4,337,163, issued to Schilp, which related to a bleach thickened with a combination of amine oxides and anionic surfactants. Abrasives are unable to be suspended in the Schilp formulas. U.S. Pat. No. 4,287,079, issued to Robinson, on the other hand, related to a clay/silicon dioxide thickened, bleach-containing abrasive cleanser which could contain an anionic surfactant. Due to the clay-thickened rheology, cleansers of this sort quickly dry out and set up. While these type of cleansers thus become less flowable over time, they are unfortunately also plagued by significant syneresis problems. U.S. Pat. No. 3,956,158, (also British Patent No. 1,418,671) issued to Donaldson shows an abrasive-containing bleach thickened with insoluble detergent filaments. As described in U.S. Pat. No. 4,352,678, compositions such as those disclosed in U.S. Pat. No. 3,956,158 have numerous disadvantages, including low detergency and lack of physical and chemical stability at higher temperatures. Lastly, U.S. Pat. No. 3,558,496, issued to Zmoda, shows a hypochlorite bleach thickened with negatively and positively charged clays.

Negatively charged clays include smectites, montmorillonites, etc., which are common clays. The positively charged clay was a fibrillar aluminum oxide. Again, due to presence of the former clays, a false body rheology is likely to occur in which hardening soon occurs and probable increased syneresis is observed.

U.S. Pat. Nos. 4,599,186, 4,657,692 and 4,695,394, all issued to Choy et al, and of common assignment herein, represent significant steps in achieving good physical and chemical stabilities of liquid abrasive cleansers containing bleach. The disclosures of these patents are incorporated herein by reference. These patents teach the use of an inorganic colloid combined with a surfactant-/electrolyte system to provide good physical stability. However because the inorganic colloid in these cleansers is basically insoluble in aqueous dispersion and must rely on its interaction with surfactants and electrolytes to maintain suspension, phase separation between the liquid, continuous phase and the solid, discontinuous phase can occur, especially under elevated temperatures and extended storage times.

Consequently, there is still a need for ways in which to maintain long-term physical stability in liquid abrasive cleansers which contain bleach.

SUMMARY OF THE INVENTION

EXPERIMENTAL

In one aspect of the invention, is disclosed a thickened liquid abrasive cleanser with enhanced long-term phase stability comprising:

(a) a colloidal aluminum oxide thickener having an average particle size, in dispersion, of no greater than 1 micron;

(b) a fatty acid soap;

(c) a bleach stable nonionic surfactant;

(d) a buffer/electrolyte which interacts with the surfactants of (b) and (c) and the thickener of (a) to result in a plastic rheology;

(e) a halogen bleach;

(f) an abrasive having a particle size of between 1 and 400 microns;

(g) a phase stabilizing amount of a $C_{10-15}$ alkyl benzene sulfonate; and (h) the remainder, water and minor amounts of miscellaneous additives.

The hard surface abrasive scouring cleansers of the invention provide excellent abrasive suspending and bleach stability in terms of long-term half life. Additionally, the cleansers of the invention also show unexpectedly substantially no syneresis. These syneresis values are also stable over time and at elevated temperatures. Because of the resulting physical stability, the cleansers do not require shaking before use to resuspend solids. The rheology is adjusted for consistent smooth flowability.

A further embodiment of the invention provides a method for preparing a thickened liquid cleanser with enhanced long-term stability comprising combining:

(a) an initial portion of all the water with a colloidal aluminum oxide thickener, and optionally, a phase stabilizing amount of a $C_{10-15}$ alkyl benzene sulfonate;

(b) a final portion of all the water and a discrete amount of a neutralizing agent;

(c) a halogen bleach;

(d) a fatty acid soap;

(e) a bleach stable nonionic surfactant, and, optionally, a phase stabilizing amount of a $C_{10-15}$ alkyl benzene sulfonate; and (f) a buffer/electrolyte which interacts with the surfactants recited in steps (d) and (e) and the thickener recited in step (a) to result in a plastic rheology, and optionally, a phase stabilizing amount of a $C_{10-15}$ alkyl benzene sulfonate;

wherein the step of adding a phase stabilizing amount of an alkyl benzene sulfonate must occur in either (a), (e) or (f).

In the method of making the thickened liquid abrasive cleanser with improved physical stability, the order addition of the ingredients is critical. In said method, it is crucial to add the phase stabilizing amount of the alkyl benzene sulfonate at either (1) just prior to neutralizing the colloidal alumina, and prior to addition of, the remaining ingredients; (2) just after all surfactants have been added; or (3) after all other ingredients have been added.

It is therefore an object of this invention to provide a bleach-containing abrasive liquid cleanser which is both physically and chemically stable.

It is another object of the invention to provide a liquid cleanser containing an inorganic colloid, a mixture of surfactants and an electrolyte/buffer resulting in a plastic rheology in which enhanced physical stability is achieved by the addition of a phase stabilizing amount of a $C_{10-15}$ alkyl benzene sulfonate.

It is yet another object of this invention to stabilize said liquid cleanser by adding said alkyl benzene sulfonate only after the non-anionic components of said cleanser have been added during the manufacture of said cleanser.

DETAILED DESCRIPTION OF THE INVENTION

The invention provides a thickened liquid abrasive cleanser with enhanced long-term phase stability comprising:

(a) a colloidal aluminum oxide thickener having an average particle size, in dispersion, of no greater than 1 micron;

(b) a fatty acid soap;

(c) a bleach stable nonionic surfactant;

(d) a buffer/electrolyte which interacts with the surfactants of (b) and (c) and the thickener of (a) to result in a plastic rheology;

(e) a halogen bleach;

(f) an abrasive having a particle size of between 1 and 400 microns;

(g) a phase stabilizing amount of a $C_{10-15}$ alkyl benzene sulfonate; and (h) the remainder, water and minor amounts of miscellaneous additives.

The previously mentioned U.S. Pat. Nos. 4,599,186, 4,657,692 and 4,695,394, all issued to Choy et al, and of common assignment herein, disclosed the significant discovery that a processed colloidal alumina, in association with surfactants and an electrolyte/buffer, would provide a thickened liquid cleanser able to contain bleach and which would be both chemically and physically stable. Additionally, unlike clay-thickened liquid cleansers (e.g., Hartman, U.S. Pat. No. 3,985,668), these colloidal alumina-containing cleansers would achieve a plastic rheology, i.e., one in which the liquid would fluidize without adding significant shear to the liquid. However, when a non-phosphate version of said cleanser was created in accordance with the teachings of U.S. Pat. No. 4,695,394, it was surprisingly discovered that such cleanser could suffer from noticeable phase separation, especially when subjected to long-term storage at elevated temperatures. Phase separation is undesirable since it may result in an inconsistent dosage of the cleanser per each use. Additionally, it is unaesthetic to the user to observe physically separated liquid.

Accordingly, applicants surprisingly discovered that the use of alkyl benzene sulfonate would substantially overcome the problem of phase separation. Alkyl benzene sulfonate is a well known anionic surfactant which has been used in various liquid cleansers (See, e.g., Clark et al, U.S. Pat. No. 4,129,527). However, nothing in prior art has disclosed, taught or suggested that alkyl benzene sulfonate can be used to physically stabilize a liquid cleanser which contains an alumina colloid as a thickener.

The individual constituents of the inventive cleansers are described more particularly below. Additionally, the term "effective amount" means an amount sufficient to accomplish the intended purpose, e.g., thickening, suspending, cleaning, etc.

Alumina

The colloidal thickening component of this invention is provided by an alumina, or hydrated aluminum oxide. A typical alumina is Disperal® (formerly called "Dispural®"), manufactured by Condea Chemie, Brunsbuettel, West Germany. Disperal® is an aluminum oxide monohydrate which forms stable colloidal aqueous dispersions. These particular types of aluminas are dry powders which can form thixotropic gels, bind silica and other ceramic substrates, possess a positive charge when dissolved in acidic media, and are substantive to a variety of surfaces. Disperal® has a typical chemical composition of 90% alpha aluminum oxide monohydrate (pseudoboehmite) 9% water, 0.5% carbon (as primary alcohol), 0.008% silicon dioxide, 0.005% ferric oxide, 0.004% sodium silicate, 0.05% sulfur. It has a surface area (BET) of about 320 $m^2$/gm, average particle size (as determined by sieving) of 15% (greater than 45 microns) and 85% (less than 45 microns), an X-ray diffraction dispersion of 0.0048 micron, and bulk density of 45 lbs./$ft.^3$ (loose bulk) and 50 lbs./$ft.^3$ (packed bulk).

Yet another alumina suitable for use is Catapal® Alumina, sold under the grades A, B and D and manufactured by Vista Chemicals Company, Houston, Tex.

These colloidal alumina thickeners, as used dispersed in the invention, generally have an exceedingly small average particle size (i.e., generally less than 1 micron). In point of fact, the average particle size diameter of these thickeners when dispersed is likely to be around 0.0048 micron. Thus, a preferred average particle size range in dispersion is preferably less than 1 micron, more preferably less than 0.5 micron, and most preferably less than 0.1 micron. Due to their small particle size, little or substantially no abrasive action is provided by these types of thickeners even though they are chemically insoluble, inorganic particles. Additionally, these colloidal aluminas are chemically quite different from aluminum oxide abrasives, such as corundum. Colloidal aluminas are produced from synthetic boehmite. In general, they are synthesized by hydrolyzing aluminum alcoholates, with resulting reaction products being hydrated aluminum oxide (colloidal alumina) and three fatty alcohols. The reaction is set forth below:

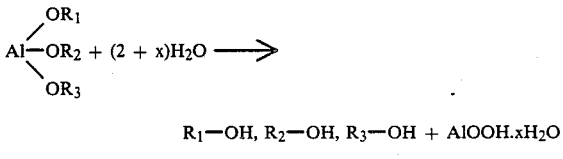

$$Al(OR_1)(OR_2)(OR_3) + (2 + x)H_2O \longrightarrow R_1{-}OH,\ R_2{-}OH,\ R_3{-}OH + AlOOH.xH_2O$$

(From Condea Chemie, "Pural® Puralox® Disperal® High Purity Aluminas" Brochure (1984), the contents of which are herein incorporated by reference thereto.)

These hydrated aluminum oxides are called synthetic boehmites merely because their crystalline structure appears similar to that of naturally occurring boehmite. Boehmite, which is the actual mineral, has a Mohs hardness of about 3. It may thus be expected that the synthetic boehmite would not have a hardness greater than the naturally occurring boehmite. Corundum, on the other hand, appears to have a Mohs hardness of at least 8 and perhaps higher. Thus, any abrasive action provided by colloidal aluminum oxides may be severely mitigated due to their relative softness. An important aspect of the hydrated aluminas used herein is that they should be chemically insoluble, i.e., should not dissolve in acidic, basic or neutral media in order to have effective thickening as well as stability properties. However, colloidal aluminas will dissolve in highly basic media, e.g., 50% NaOH.

A further important point is that these colloidal alumina thickeners, in order to be useable as thickeners in the cleansers of this invention, must be initially dispersed in aqueous dispersion by means of strong acids. Preferable acids used to disperse these colloidal aluminas include, but are not limited to, acetic, nitric and hydrochloric acids. Sulfuric or phosphoric acids are not preferred.

Generally, a 1–50%, more preferably 5–40%, and most preferably, 10–35% dispersion is made up, although in the Examples, percentages of colloidal alumina are calculated for 100% (i.e., as if non-dispersed in solution) active content. In practice, the colloidal alumina may be dispersed in water sufficient to make up the desired % dispersion and then the acid may be added thereto. Or, the acid may be first added to the colloidal alumina and then dispersed in water. The alumina is dispersed in water with sufficient mixing. Usually, a relatively small amount of concentrated acid is added, for instance, for a 25 wt. % dispersion, 25% alumina monohydrate may be combined with 1.75% concentrated (12M) hydrochloric acid and then dispersed in 73.75% water.

Neutralization of the acidified colloid is necessary to obtain the desired, finished product rheology (i.e., it thickens). Thus, the acidified, diluted colloid is neutralized, preferably by sodium hydroxide (e.g., a 50% solution), although if the electrolyte/buffer is sodium carbonate or sodium silicate, it may be possible to forgo the sodium hydroxide as a separate component. Secondly, since a halogen bleach is desired to be added to the cleansers of this invention, and such bleaches are unstable in the presence of acid, neutralization is also desirable. The alkaline neutralizing agent can be added separately.

With respect to thickening, it should be noted that while there are many types of inorganic and organic thickeners, not all will provide the proper type of plastic, flowable rheology desired in the invention. Common clays, for instance, those used in U.S. Pat. Nos. 3,985,668 and 3,558,496, will likely lead to a false body rheology. False body rheology pertains to liquids which, at rest, turn very viscous, i.e., form gels. Problematic with such false body liquids is that they appear to tend to thicken very rapidly and harden or set up so that flowability is a problem. A thixotropic rheology is also not particularly desirable in this invention since in the thixotropic state, a liquid at rest also thickens dramatically, but, theoretically, should flow upon shearing. If the thixotrope has a high yield stress value, as typically found in clay-thickened liquid media, the fluid at rest may not re-achieve flowability without shaking or agitation. As a matter of fact, if colloidal alumina alone is used to thicken the liquid cleansers of this invention, a thixotrope with high yield stress values appears to result. This type of product is less preferred, and therefore, the surfactants included in the formulas of this invention are crucial towards achieving a desired, creamy, plastic rheology. Ordinarily, a thixotrope should flow from a dispenser upon shaking or squeezing. An example of a typical thixotrope is catsup, which sometimes requires quite a bit of shaking and pounding of the bottle bottom containing it to induce flow.

The type of rheology desired in this invention is a plastic, flowable rheology. This sort of rheology does not require shearing to promote fluidity. Thus, a product made in accordance with this invention will not generally require squeezing (assuming a deformable plastic squeeze bottle), shaking or agitation to flow out of the container or dispenser. Attaining this rheology with the inventive cleansers was very surprising since, although it is known that combinations of surfactants can result in this rheology (e.g., U.S. Pat. Nos. 4,129,527 and 4,352,678), addition of the aluminum oxide thickeners might ordinarily be expected to affect the rheology differently. It was surprising that the aluminum oxide thickeners would promote such plastic rheology while also stably suspending abrasives and not causing bleach instability. One patent, U.S. Pat. No. 3,558,496, had suggested coupling an aluminum oxide with common clays to thicken hypochlorite, but had not indicated omitting the clay and adding surfactants would lead to the desired plastic rheology of this invention.

Surfactants

As mentioned herein above, the surfactants suitable for use in this invention are selected from anionic, bleach-stable nonionic, amphoteric, zwitterionic surfactants and mixtures thereof. It is especially preferred to use a combination of anionics and bleach-stable nonionics.

The anionic surfactants are selected from bleach/stable surfactants such as alkali metal alkyl sulfates, secondary alkane sulfonates (also referred to as paraffin sulfonates), primary alkane sulfonates, fatty acid soaps, and mixtures thereof. These anionic surfactants will preferably have alkyl chain groups averaging about 6 to 20 carbon atoms. In practice, any other anionic surfactants which do not degrade chemically when in contact with a hypohalite, e.g., hypochlorite, bleaching species should also work. An example of a particularly preferred secondary alkane sulfonate is HOSTAPUR SAS, manufactured by Farbwerke Hoechst A.G., Frankfurt, West Germany. Another example of an alkane sulfonate is Mersolet, which has an alkyl group of about 13–15 carbon atoms, and is sold by Mobay Chemical Company. An example of typical alkali metal alkyl sulfates is Conco Sulfate WR, which has an alkyl group of about 16 carbon atoms, and is sold by Continental Chemical Company. When the electrolyte used is an alkali metal silicate, it is most preferable to include a soluble alkali metal soap of a fatty acid, such as a $C_{6-18}$, more preferably $C_{10-16}$, fatty acid soap. Especially preferred are sodium and potassium soaps of lauric and myristic acid.

Examples of preferred bleach-stable nonionic surfactants are amine oxides, especially trialkyl amine oxides. A representative structure is set forth below.

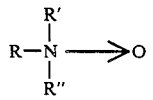

In the structure above, R′ and R″ can be alkyl of 1 to 3 carbon atoms, and are most preferably $CH_3$—, and R is alkyl of about 10 to 20 carbon atoms. When R′ and R″ are both $CH_3$— and R is alkyl averaging about 12 carbon atoms, the structure for dimethyldodecylamine oxide, a particularly preferred amine oxide, is obtained. Representative examples of these particular type of bleach-stable nonionic surfactants include the dimethyldodecylamine oxides sold under the trademark Ammonyx® LO by Stepan Chemical Company of Chicago, Ill. Yet other preferred amine oxides are those sold under the trademark Barlox®, by Baird Chemical Industries, Inc. Still others include the Conco XA series, sold by Continental Chemical Company, the Aromax series sold by Armour Industrial Chemical Company, and the Schercamox series, sold by Scher Brothers, Inc. These amine oxides preferably have main alkyl chain groups averaging about 10 to 20 carbon atoms. Other types of suitable surfactants include amphoteric surfactants, exemplary of which are betaines, imidazolines and certain quaternary phosphonium and tertiary sulfonium compounds. Particularly preferred are betaines such as N-carboxymethyl-N-dimethyl-N-(9-octadecenyl) ammonium hydroxide and N-carboxymethyl-N-cocoalkyl-N-dimethyl ammonium hydroxide, the latter of which is sold under the trademark Lonzaine® by Lonza Corporation.

As mentioned previously, it is particularly preferred to combine at least two of these surfactants, most preferably the anionics and the bleach stable nonionics. Combinations of these types of surfactants appear to be particularly favorable to maintaining hypochlorite half-life stability at elevated temperatures for long periods of time. Additionally, when these particular combinations of surfactants are combined with the alumina thickener, the formulations thus produced generally suspend abrasives quite well.

Determining an appropriate mixture of alumina and surfactants is very important to the invention. While theoretically anywhere from about 1% to 15% alumina can be used, and about 0.1 to 15% surfactants (anionic, bleach stable nonionic or mixtures thereof), so long as proper rheology (plastic, flowable), desirable bleach stability and lack of phase separation or syneresis result, in practice it is preferred to use minimal quantities of these "actives." (Note: Commercially available surfactants are generally sold as solutions, e.g., Hostapur SAS (Hoechst A.G.) is a 60% sodium paraffin sulfonate solution, and Ammonyx LO (Stepan Chemical Co.) is a 30% amine oxide solution. However, as in the case with the colloidal alumina thickener dispersions discussed above, in the Examples shown below, the percentages of each surfactant used is calculated as if 100% surfactant were used.)

The amount of each active added is dictated by the type of product performance desired, i.e., thickening, cleaning, lack of or substantially no syneresis, abrasive suspending or bleach stabilizing. The amount that is ordinarily used is an amount which is both abrasive-suspending and cleaning-effective amount. Applicants have found that preferably about 1% to 10%, and most preferably about 2% to 6% alumina, and preferably about 0.25% to 10.0%, most preferably about 0.5% to 5.0% of total surfactant are used in the cleansers of this invention. These ranges appear to result in compositions having the desired syneresis values, ability to suspend abrasives, optimal bleach half-lives, and, because of the reduced amount of actives in the compositions, lower overall manufacturing costs. It is crucial to use this combination of alumina and surfactants. As mentioned, using a mixed surfactant system alone, in high amounts to provide proper rheology (plastic) for suspension of abrasives, results in reduced bleach half-life when a bleach is incorporated. Alumina, by itself, on the other hand, provides a composition with unacceptable syneresis.

Phase Stabilizer

It has been surprisingly discovered that small amounts of sodium $C_{10-15}$ alkyl benzene sulfonate acts as a phase stabilizer to greatly improve phase stability of the inventive cleanser. EP No. 216 416, published Apr. 1, 1987, noted that a crucial ratio of alkyl benzene sulfonate (LAS) to sodium secondary alkane sulfonate (SAS) would improve the viscosity of a non-bleach containing formulation in which polyacrylate thickener and solvents are present. However, that application does not teach, disclose or suggest that alkyl benzene sulfonate can be used to greatly improve phase stability in a liquid system which contains bleach and is thickened with surfactants, electrolytes and colloidal alumina. Further, nothing in the prior art teaches, discloses or suggests the importance of the addition order of the alkyl benzene sulfonate.

It is preferred that about 0.05–10%, more preferably 0.1–7%, and most preferably, about 0.1–5% by weight alkyl benzene sulfonate be added as a phase stabilizer. Suitable alkyl benzene sulfonates have an average chain length of 10–15 carbons. Exemplary of these are Calsoft surfactants sold by Pilot Chemical Company under the designations of F-90 and L-40; and Biosoft LAS 40-S, sold by Stepan Chemical Company.

It is not entirely understood why LAS improves the stability of these liquid cleansers. However, without being bound to any particular theory, applicants speculate that in the invention, certain relationships among the solids portion result in the particular rheological characteristics of the invention. For instance, the alumina imparts a particularly high viscosity to a liquid system which requires the use of surfactants and electrolytes to break up. On the other hand, when silicate is used as the electrolyte in combination with alumina, a chain structure network may form in the liquid matrix which requires the presence of a fatty acid soap to disrupt. However, in order to best take advantage of LAS's phase stabilizing action, it was further surprisingly discovered that there are three points in order of addition of ingredients where the LAS can be added: (1) after the colloidal alumina, which has been acidified in aqueous media and prior to being neutralized; and (2) after the last of the surfactants is added, and before the electrolyte (silicate) is added; and (3) after all ingredients are added and the LAS is the last ingredient. Of these, addition points (1) and especially (2) are preferred.

Again, without being bound by theory, applicants speculate that by adding LAS in the first instance, after the colloid is processed, and prior to addition of other solids, there is an enhancement of the rheology of the system. Further, and again, without being bound by theory, applicants believe that in case (2), this may be due to enhanced flocculation of the positively charged colloid resulting from absorption of LAS on the surface of the alumina. Further non-limiting theories are discussed in the Method of Preparing section below.

Other materials may be possible alternates to LAS. For instance, possible equivalents are substituted alkyl benzenes of the structure

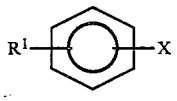

wherein $R^1$ is $C_{10-15}$ alkyl, X is selected from $CO_2^-M^+$, $SO_4^-$, or $PO_4^=(M^+)_2$, and $M^+$ is an alkali metal cation. Also, other alkali metal alkyl benzene sulfonates fall within the scope of this invention. Further, the acidic surfactant, alkyl benzene sulfonic acid (HLAS) can be utilized, so long as it is first pre-neutralized.

Electrolytes/Buffers

The electrolyte/buffers appear to promote the favorable environment in which the surfactants and the alumina can combine. Electrolytes function, on the one hand, to provide sources of ions in aqueous solution. This provides a charged medium in which the alumina thickener and surfactants can interact, providing the favorable plastic rheology of the invention. Buffers, on the other hand, may act to maintain pH, and in this instance, alkaline pH is favored for purposes of both rheology and maintaining hypochlorite stability. Some compounds will serve as both buffer and electrolyte. These particular buffers/electrolytes are generally the alkali metal salts of various inorganic acids, to wit the alkali metal salts of orthophosphates, polyphosphates, pyrophosphates, triphosphates, tetraphosphates, silicates, metasilicates, polysilicates, carbonates, hydroxides, and mixtures of the same. Certain divalent salts, e.g., alkaline earth salts of phosphates, carbonates, hydroxides, etc., can function singly as buffers. If such compounds were used, they would be combined with at least one of the previous electrolytes/buffers mentioned to provide the appropriate pH adjustment. It may also be suitable to use as buffers such materials as aluminosilicates (zeolites), borates, aluminates and bleach-stable organic materials, such as the alkali metal gluconates, succinates, and maleates. Sodium chloride or sodium sulfate could be utilized as electrolytes, but not buffers, if necessary, to maintain the ionic strength necessary for the desired rheology. An especially preferred electroylte/buffer is an alkali metal silicate, which, as previously mentioned herein, is employed in combination with an alkali metal fatty acid soap to provide the particular, plastic rheology desired in this invention. The preferred silicate is sodium silicate, which has the empirical formula $Na_2O:SiO_2$. The ratio of sodium oxide:silicon dioxide is about 1:1 to 1:4, more preferably about 1:2 to 1:3. Silicates are available from numerous sources, such as PQ Corporation. These electrolyte/buffers function to keep the pH ranges of the inventive cleaners preferably above 7.0, more preferably at between about 10.0 to 14.0. The amount of electrolyte/buffer can vary from about 1.0% to 25.0%, preferably 1.0 to 10.0%.

Halogen Bleach

A source of bleach is selected from various halogen bleaches. For the purposes of this particular invention, halogen bleaches are particularly favored. As examples thereof, the bleach may be preferably selected from the group consisting essentially of the alkali metal and alkaline earth salts of hypohalite, hypohalite addition products, haloamines, haloimines, haloimides and haloamides. These also produce hypohalous bleaching species in situ. Preferred is hypochlorite and compounds producing hypochlorite in aqueous solution, although hypobromite is another potential halogen bleach. Representative hypochlorite producing compounds include sodium, potassium, lithium and calcium hypochlorite, chlorinated trisodium phosphate dodecahydrate (hypohalite addition product), potassium and sodium dichloroisocyanurate, trichlorocyanuric acid, dichlorodimethyl hydantoin, chlorobromo dimethylhydantoin, N-chlorosulfamide (haloamide), and chloroamine (haloamine). Particularly preferred in this invention is sodium hypochlorite having the chemical formula NaOCl, in an amount ranging from about 0.01% to about 15%, more preferably about 0.25% to 5%, most preferably about 0.5% to 2.0%. The purpose for the bleach is evident. This particular sort of oxidizing cleaning agent is very effective against oxidizable stains, e.g., organic stains. The principle problem with bleach is also apparent—in combination with most actives in an aqueous system, oxidation occurs, and the bleach's efficacy can be greatly reduced. As mentioned, it is particularly surprising that in the composition of this invention, bleach stability as expressed in half-lives is so excellent, which, in a commercial setting, is a necessary requirement to market a shelf-stable product that maintains its efficacy throughout its shelf-life.

Abrasives

Abrasives are used in the invention to promote cleaning action by providing a scouring action when the cleansers of the invention are used on hard surfaces. Preferred abrasives include silica sand, but other hard abrasives such as a perlite, which is an expanded silica, and various other insoluble, inorganic particulate abrasives can be used, such as quartz, pumice, calcium carbonate, feldspar, tripoli and calcium phosphate. Abrasives can be present in amounts ranging from about 5 to 70% by weight of the compositions of this invention. Particle size will range from average particle size of about 1 to 400, more preferably 5 to 300, most preferably 10 to 250 microns. Abrasives are generally sold as grades based on U.S. Mesh Sieve sizes. The U.S. Sieve sizes are inversely related to measurements in microns, wherein 80 mesh sieve sizes correspond to about 180 microns, and 325 mesh sieves correspond to about 45 microns. For one preferred grade of abrasives used in this invention, namely grade 140 mesh, more than about 20% of the particles will be retained on a U.S. mesh 325 sieve (i.e., is greater than about 45 microns). Particle hardness of the abrasives can range from Mohs hardness of about 2–8, more preferably 3–6. Abrasives are generally insoluble inorganic materials (although there are some organic abrasives, to wit, polyvinyl chloride granules, corn cobs, rice hulls, melamine granules, urea formaldehyde, etc.). Especially preferred as abrasives herein are calcium carbonate particles, also known as calcite. They are available from numerous commercial sources such as Georgia Marble Company, and have a Mohs hardness of about 3. Typically, a size of U.S. 140 mesh is selected, although others may be appropriate. Some thickeners are also insoluble inorganic materials, for instance, the aluminum oxide thickeners of this invention. However, because of the relatively small surface area of the abrasives, compared to the thickeners, which are of much smaller average particle diameter, little or no thickening occurs with the abrasives. Further, without the aluminum oxide thickeners of this invention, these abrasives cannot be stably suspended.

Water

Water is the medium used as the continuous phase in which the solids are suspended. Some of the components, e.g., the liquid surfactants, the neutralizing agent, the phase stabilizer and electrolyte/buffer, may be added to the cleanser in a water base, thus contributing to the total water present in the cleanser. While water and the miscellaneous minors make up the remainder of the composition, water is generally present in amounts ranging from 10–80% by weight of the cleanser.

Miscellaneous Additives

Further desirable adjuncts include bleach stable dyes (e.g., anthraquinone dyes, e.g., U.S. Pat. Nos. 4,661,293 and 4,457,855), pigments (e.g.s., $TiO_2$, ultramarine blue, e.g., U.S. Pat. No. 4,708,816), colorants and fragrances (generally, blends of organic compounds such as ketones, aldehydes, essential oils and the like which are proprietary to such manufacturers as International Flavors and Fragrances, Givaudan and Firmenich; See, e.g., U.S. Pat. No. 3,876,551) in relatively low amounts, e.g., about 0.001% to 5.0%, each, by weight of the composition.

Method of Preparing

As previously mentioned, the method of preparing the liquid cleanser of this invention comprises combining:

(a) an initial portion of all the water with a colloidal aluminum oxide thickener, and optionally, a phase stabilizing amount of a $C_{10-15}$ alkyl benzene sulfonate;

(b) a final portion of all the water and a discrete amount of a neutralizing agent;

(c) a halogen bleach;

(d) a fatty acid soap;

(e) a bleach stable nonionic surfactant, and, optionally, a phase stabilizing amount of a $C_{10-15}$ alkyl benzene sulfonate; and (f) a buffer/electrolyte which interacts with the surfactants recited in steps (d) and (e) and the thickener recited in step (a) to result in a plastic rheology, and optionally, a phase stabilizing amount of a $C_{10-15}$ alkyl benzene sulfonate;

wherein the step of adding a phase stabilizing amount of an alkyl benzene sulfonate must occur in either (a), (e) or (f).

As similarly described in U.S. Pat. No. 4,657,692 (Column 13, incorporated herein by reference thereto), to produce the cleanser, alumina is charged into a vat or suitable mixing vessel which has been provided with a suitable mixing means, such as an impeller, which is in constant agitation with suitable angular velocity. The alumina is acidified and diluted with about 50% of the total water used. Now, in the invention, the alkyl benzene sulfonate phase stabilizer can be optionally added at this point. Next, a neutralizer, such as a 50% NaOH solution can be added, with the remainder of the water. Next, halogen bleach and abrasives can be added. Thereafter, the anionic surfactants are added. When silicate is used as the electrolyte/buffer, it is necessary to have a fatty acid soap as one of the anionic surfactants since, as explained in U.S. Pat. No. 4,695,394, the soap appears to surprisingly break up any network which could form between the silicate and the colloidal alumina. Next, the bleach-stable nonionic surfactant is added, which is generally a trialkyl amine oxide (although a betaine or other surfactant would likely be suitable). At this point in the invention, the alkyl benzene sulfonate is most preferably, although optionally, added. Finally, the electrolyte/buffer is added. Note that at virtually any step in this method, the optional minor ingredients, such as fragrance and pigments could be added. However, since fragrance is an organic component which may be more susceptible to oxidation by the halogen bleach, it is preferable to add it last. The alkyl benzene sulfonate, consistent with the invention, can optionally be the last ingredient added.

In the method of making the thickened liquid abrasive cleanser with improved physical stability, the order addition of the ingredients is critical. In said method, it is crucial to add the phase stabilizing amount of the alkyl benzene sulfonate at either (1) just prior to neutralizing the colloidal alumina, and prior to addition of, the remaining ingredients; (2) just after all surfactants have been added; or (3) after all other ingredients have been added.

As will be noted from the above, the alkyl benzene sulfonate, which is an anionic species (negatively charged active) in aqueous media, is added specifically after any non-anionic species has been added during the manufacture, with the exception of the buffer/electrolyte, which is preferably alkali metal silicate. As discussed in the section on alumina, the alumina colloid is first acidified. However, just prior to being neutralized (in order to maintain chemical stability and to prevent reaction with the halogen bleach), the alkyl benzene sulfonate can be added in the preferred addition point. While not wishing to be bound to any one particular theory, applicants speculate that the alumina, which by acidification, has become protenated, does not repel the alkyl benzene sulfonate, and the phase stabilizer becomes physically associated with the colloid. This results in a more flocculated system, leading to enhanced physical stability and more preferred flow characteristics.

In the preferred second addition point, which is just after the bleach-stable nonionic surfactant has been added, it is similarly believed, again, without being bound by theory, that since the soap, another anionic surfactant which is neither soap nor alkyl benzene sulfonate, or a combination thereof, have previously been added, the bleach-stable nonionic surfactant (preferably, amine oxide), acts to prevent a charge repulsion between the soap or other anionic surfactant and the alkyl benzene sulfonate.

Lastly, in the third preferred addition point, the alkyl benzene sulfonate can be added after all ingredients have already been added. In the present method, the electrolyte/buffer (preferably, silicate) is the last ingredient added. Once more, without being bound by theory, with the addition of the alkyl benzene sulfonate, the degree of charge repulsion is reduced, thus reducing the interaction between the alumina and the soluble silicate.

The invention will be further described with references to the Examples which follow:

TABLE I

| LIQUID CLEANSER FORMULATION | |
|---|---|
| INGREDIENT | WT. % |
| Calcium Carbonate[1] | 30.00 |
| Aluminum Oxide[2] | 4.00 |
| Sodium Silicate[3] | 2.00 |
| Secondary Alkane Sulfonate[4] | 1.75 |
| Sodium Hypochlorite[5] | 1.05 |
| Sodium Hydroxide (50% aq. sol.) | 0.975 |
| Amine Oxide[6] | 0.90 |
| Titanium Dioxide[7] | 0.75 |
| Sodium Laurate[8] | 0.70 |
| Sodium $C_{11.5}$ Alkyl Benzene Sulfonate[9] | 0.50 |
| Hydrochloric Acid | 0.07 |
| Fragrance | 0.04 |
| Water[10] | q.s. |
| | 100.00% |

[1]Abrasive from Georgia Marble.
[2]Disperal, $Al_2O_3 \times H_2O$, from Condea Chemie.
[3]Sodium Silicate RU from PQ Corporation.
[4]Hostapur SAS, secondary alkane sulfonate (60%) from Hoechst A.G.
[5]Clorox® Liquid Bleach, added as 5.80% solution.
[6]Ammonyx LO/CO Blend, dimethyldodecyl/dimethylhexadecylamine oxide (30%) from Stepan Chemical Company.
[7]Pigment.
[8]Neofat 12-43, $C_{12}$ fatty acid soap from Armak Division of Akzona, Inc.
[9]Biosoft LAS 40-S (40%) from Stepan Chemical Company.
[10]Added in two parts: about ½ with the aluminum oxide and the acid; the second ½ as a carrier for the NaOH.

In order to assess the order in which the alkyl benzene sulfonate should be added, the following stepwise order addition for the liquid cleanser was established. In the sequence, the letters (A) through (F) identify where in the order alkyl benzene sulfonate phase stabilizer was added.

ADDITION ORDER

Dispersed Aluminum Oxide
(A)
Neutrializing Agent
(B)
Halogen Bleach
Pigment
Abrasives ($CaCO_3$)
Anionic Surfactant
(C)
Fatty acid Soap
(D)
Bleach-Sable Nonionic Surfactant
(E)
Electrolyte/Buffer
(F)

The results in Tables II below disclose the effect of adding the phase stabilizer at the various points in the addition order:

TABLE II

| % AQUEOUS LAYER SEPARATION | | |
|---|---|---|
| EXAMPLE | 4 Weeks at 120° F. | 4 Weeks at 100° F. |
| A | 1.6 | trace (approx 1%) |
| B | 4.3 | 4.5 |
| C | 4 | 3 |
| D | 5 | 3 |
| E | 2 | heavy detection (approx 5%) |
| F | 3 | 1.5 |
| CONTROL (No LAS) | 4 | 4 |

From the foregoing, it can be observed that the order addition for the alkyl benzene sulfonate is crucial. When added at points (A), (E) or (F), there is superior stability as compared to a Control example. On the other hand, when deviating from these addition orders, physical stability may not only not significantly differ from Control, but may actually be somewhat worse.

The results in TABLE III below were based on the same order addition, with the proviso that the neutralizing agent, NaOH, was present in the fatty acid. Also, unlike in TABLE II, there was no addition point F.

TABLE III

| AQUEOUS LAYER SEPARATION | | |
|---|---|---|
| EXAMPLE | 4 Weeks at 120° F. | 4 Weeks at 100° F. |
| A | 8 | 10 |
| B | 5 | 7 |
| C | 17 | 15 |
| D | 10 | 6 |
| E | 2 | 4 |
| CONTROL (No LAS) | 7 | 6 |

Finally, in TABLE IV below, alkyl benzene sulfonate was added to a formulation in which silica sand was the abrasive. Even though the sand particles are heavier than the calcium carbonate used in TABLES II and III, there still was a significant benefit found in using alkyl benzene sulfonate as a phase stabilizer. In this formulation, the following order addition was used.

ADDITION ORDER

Dispersed Alumina
Pigment
Sand
Anionic Surfactant
Bleach Stable Nonionic Surfactant
Fragrance
Halogen Bleach
Electrolyte/Buffer
(A) LAS

TABLE IV

| % AQUEOUS LAYER SEPARATION | | |
|---|---|---|
| EXAMPLE | 4 Weeks at 120° F. | 4 Weeks at 100° F. |
| A | 8 | 5 |
| Control (No LAS) | 13 | 11 |

The invention is not limited to the foregoing description and examples. Obvious equivalents and embodiments coming within the scope and intent of the invention are included hereunder. For example, it may be possible to rearrange the preferred sequence of addition. However, if the general principles are adhered to, for example, taking care that the alkyl benzene sulfonate is portioned appropriately in the addition order, such falls within the scope and content of the invention. The invention is further characterized with reference to the claims which follow.

We claim:

1. A method for preparing a thickened liquid cleanser with enhanced long-term stability comprising combining:

(a) an initial portion of all the water with sufficient colloidal aluminum oxide thickener to provide a 1–50% dispersion thereof, and optionally, a phase stabilizing-effective amount of a $C_{10-15}$ alkyl benzene sulfonate;

(b) a final portion of all the water and an effective amount of a neutralizing agent to neutralize the collodal aluminum oxide thickener;

(c) 0.1–15% of a halogen bleach;

(d) a fatty acid soap;

(e) a bleach stable nonionic surfactant, optionally, a phase stabilizing-effective amount of a $C_{10-15}$ alkyl benzene sulfonate; and (f) 1–25% of buffer/electrolyte which interacts with the surfactants recited in steps (d) and (e) and the thickener recited in step (a) to result in a plastic rheology, and optionally, a phase stabilizing-effective amount of $C_{10-15}$ alkyl benzene sulfonate;

wherein the step of adding a phase stabilizing-effective amount of an alkyl benzene sulfonate must occur in either (a), (e) or (f); the total amount of all of the water comprising 10–80%; and the amount of soap and surfactant of steps (d) and (e) being about 0.1–5%.

2. The method of claim 1 wherein the additional of alkyl benzene sulfonate occurs at (a).

3. The method of claim 1 wherein the addition of alkyl benzene sulfonate occurs at (e).

4. The method of claim 1 wherein the addition of alkyl benzene sulfonate occurs at (f).

5. The method of claim 1 wherein miscellaneous additives selected from the group consisting of pigments, bleach-stable dyes, colorants and fragrances are added at (a), (b) (c), (d), (e), (f), or mixtures thereof.

6. The method of claim 1 wherein said buffer/electrolyte is alkali metal silicate.

7. The method of claim 3 wherein step (c) further includes an anionic surfactant which is neither soap nor alkyl benzene sulfonate and is selected from the group consisting of secondary alkane sulfonates, primary alkane sulfonates, alpha-olefin sulfonates, alkyl sulfates and mixtures thereof.

8. The method of claim 3 wherein the neutralizing agent of (b) is an alkali metal hydroxide.

9. The method of claim 8 wherein said alkali metal hydroxide is sodium hydroxide.

* * * * *